US010932026B2

(12) United States Patent
Uhring-Cadart et al.

(10) Patent No.: US 10,932,026 B2
(45) Date of Patent: Feb. 23, 2021

(54) BROADBAND ELECTRODYNAMIC TRANSDUCER FOR HEADPHONES, AND ASSOCIATED HEADPHONES

(71) Applicant: FOCAL JMLAB, La Talaudiere (FR)

(72) Inventors: Ludovic Uhring-Cadart, Sorbiers (FR); Clement Auzou, Saint Etienne (FR); Arnaud Cazes Bouchet, Balbigny (FR)

(73) Assignee: FOCAL JMLAB, La Talaudiere (FR)

( * ) Notice: Subject to any disclaimer, the term of this patent is extended or adjusted under 35 U.S.C. 154(b) by 0 days.

(21) Appl. No.: 16/307,575

(22) PCT Filed: Jun. 13, 2017

(86) PCT No.: PCT/EP2017/064332
§ 371 (c)(1),
(2) Date: Dec. 6, 2018

(87) PCT Pub. No.: WO2017/216126
PCT Pub. Date: Dec. 21, 2017

(65) Prior Publication Data

US 2019/0306605 A1 Oct. 3, 2019

(30) Foreign Application Priority Data

Jun. 13, 2016 (FR) ..... 1655416

(51) Int. Cl.
*H04R 9/04* (2006.01)
*H04R 1/10* (2006.01)
(Continued)

(52) U.S. Cl.
CPC ..... *H04R 1/10* (2013.01); *H04R 7/12* (2013.01); *H04R 9/045* (2013.01); *H04R 5/033* (2013.01); *H04R 7/20* (2013.01); *H04R 2307/027* (2013.01)

(58) Field of Classification Search
CPC combination set(s) only.
See application file for complete search history.

(56) References Cited

U.S. PATENT DOCUMENTS 9,883,290 B2 * 1/2018 Timothy ..... H04R 9/045
9,998,829 B2 * 6/2018 Asfaw ..... H04R 9/025
(Continued)

FOREIGN PATENT DOCUMENTS

JP 08205285 * 1/1995 ..... H04R 9/00
WO WO2007093903 * 2/2006 ..... H04R 7/12
WO WO-2007093903 A1 8/2007

OTHER PUBLICATIONS

International Search Report for Corresponding International Application No. PCT/EP2017/064332, dated Aug. 24, 2017 (3 pgs).
(Continued)

*Primary Examiner* — Amir H Etesam
(74) *Attorney, Agent, or Firm* — Harris Beach PLLC

(57) ABSTRACT

The invention relates to a broadband electrodynamic transducer for headphones, said transducer comprising: —a magnetic motor designed to generate a magnetic field; —a coil that is disposed in the air gap of the magnetic motor and can move translationally under the effect of the magnetic field; and —a membrane that is connected to the coil in such a way as to convert the translational movement of the coil into an acoustic wave; —the transducer comprising a self-supporting coil that is glued to the membrane, the membrane having a Young's modulus of more than 40 GPa.

8 Claims, 2 Drawing Sheets

(51) Int. Cl.

| | |
|---|---|
| ***H04R 7/12*** | (2006.01) |
| *H04R 5/033* | (2006.01) |
| *H04R 7/20* | (2006.01) |

(56) References Cited

U.S. PATENT DOCUMENTS

| | | | | |
|---|---|---|---|---|
| 10,178,469 | B2 * | 1/2019 | Asfaw | H04R 11/14 |
| 2014/0072163 | A1 | 3/2014 | Yamada | |
| 2016/0014522 | A1 * | 1/2016 | Matsumura | H04R 7/18 381/398 |
| 2016/0150311 | A1 | 5/2016 | Bremyer | |
| 2016/0192087 | A1 * | 6/2016 | van Halteren | H04R 23/02 381/312 |

OTHER PUBLICATIONS

Hiraga, Jean: "Support de la bobine mobile," 2000, Les haut-parleurs (2 pgs).
https://www.techhive.com/article/3230375/focal-clear-review-one-of-the-finest-headphones-money-can-buy-and-youll-need-lots-of-it.html.
https://www.soundandvision.com/content/focal-clear-headphones-review.
https://www.focal.com/sites/www.focal.fr/files/shared/catalog/award/avt_18_focal.pdf.
https://www.lydogbilde.no/test/hodetelefoner/focal-clear-2.
https://www.hifinews.com/content/focal-clear-headphones.
https://www.focal.com/sites/www.focal.fr/files/shared/catalog/award/the-clear-choice-5-globes_hifi-world.pdf.
https://www.focal.com/sites/www.focal.fr/files/shared/catalog/award/test_clear_elear_stereoplay.p.df.
https://www.avsforum.com/review-focal-clear-headphones/.
https://www.cnet.com/pictures/wowza-the-audiophiliac-picks-the-best-headphones-from-26-to-6000/.
https://www.innerfidelity.com/content/focal-clear-over-ear-open-headphones.
https://www.focal.com/sites/www.focal.fr/files/shared/catalog/award/test-lesnumeriques-focal-clear.pdf.
https://www.innerfidelity.com/content/innerfidelity-editors-choice-components-2500-and-over.
https://www.audioreputation.com/2019-product-of-the-year-award-winners/#Focal_Utopia_8211_Best_Open-Back_Over-Ear_Headphones <https://www.audioreputation.com/2019-product-of-the-year-award-winners/.
https://headphonereview.com/over-ear/focal-utopia-headphones-review/.
https://www.focal.com/sites/www.focal.fr/files/shared/catalog/award/july2018_edschoice_focal_utopia.pdf.
https://www.focal.com/sites/www.focal.fr/files/shared/catalog/award/focal-utopia-_hi-fi-world-award.pdf.
https://www.focal.com/sites/www.focal.fr/files/shared/catalog/award/hi-fi-world-utopia-focal_0.pdf.
https://www.themasterswitch.com/review-focal-utopia.
http://www.the-ear.net/review-hardware/focal-utopia-open-back-dynamic-headphone.
http://www.lydogbilde.no/test/hodetelefoner/focal-utopia.
https://www.stereopluss.no/focal-utopia-grensesprengende-hodetelefoner.5963310.html.
https://www.on-mag.fr/index.php/topaudio/tests-auditions/15806-test-focal-utopia-un-casque-hi-fi-qui-etablit-de-nouvelles-refere.
https://www.focal.com/sites/www.focal.fr/files/shared/catalog/award/test_utopia_stereoplay.pdf.
https://www.innerfidelity.com/content/worlds-best-headphone-focal-utopia#x7oUPVVTYib9erY0.97 <https://www.innerfidelity.com/content/worlds-best-headphone-focal-utopia.
https://www.whathifi.com/focal/utopia/review.
https://www.headfonia.com/best-headphones/.
https://www.innerfidelity.com/content/enter-next-generation-focal-elear-headphone#V4HePyq5W91IIT5Z.97 <https://www.innerfidelity.com/content/enter-next-generation-focal-elear-headphone.
https://www.hifinews.com/content/avtech-awards-20172018.
https://positive-feedback.com/audio-discourse/the-year-2017/.
https://www.stereopluss.no/svaert-dynamiske-franske-fristelser.6018241-357213.html.
https://www.focal.com/sites/www.focal.fr/files/shared/catalog/award/2017-05-05_elear_hifiworld_5stars.pdf.

* cited by examiner

BROADBAND ELECTRODYNAMIC TRANSDUCER FOR HEADPHONES, AND ASSOCIATED HEADPHONES

CROSS-REFERENCE TO RELATED APPLICATIONS

This application is a national stage application under 35 U.S.C. § 371 of PCT Application No. PCT/EP2017/064332, filed on Jun. 13, 2017, which claims priority to and the benefit of French Application No. 1655416 filed on Jun. 13, 2016, which are incorporated herein by reference in their entirety.

TECHNICAL FIELD

The invention relates the domain of broadband electrodynamic transducers for headphones. A broadband transducer corresponds to a transducer configured to provide, alone, the reproduction of sounds for the human ear, unlike the architectures incorporating several transducers, for example with a first speaker configured for generating low frequencies and a second speaker configured for generating high frequencies.

More specifically, the invention targets the field of high-fidelity sound reproduction, and by limiting the degradation of the sound.

More generally, the invention relates to a headset incorporating an electrodynamic transducer.

PRIOR ART

An electrodynamic transducer is a device converting an electric signal into an acoustic wave. To do that, an electrodynamic transducer is generally formed from a magnetic motor, coil, membrane and suspension. The motor has a groove, called air gap, into which enters the coil configured to sense the magnetic field so as to move in translation under the effect of the magnetic force on the current therein. The coil is fixed with the membrane having a shape of revolution suited to transform the translational movement of the coil into an acoustic wave.

The mobile part of an electrodynamic transducer is therefore composed of the coil and the membrane. This mobile part is guided in displacement by a suspension disposed around the membrane.

The mobile part is characterized by at least three mechanical properties which have impacts on the performance of the electrodynamic transducer.

Thus, a first parameter involves the stiffness of the membrane. In fact, the stiffer a membrane is, the less it is deformable and therefore the better it performs the role of piston with which to generate movements of nearby air masses with kinematics faithful to the control signal. In other words, the stiffer a membrane is, the more it can operate as a piston, limiting, even eliminating distortion phenomena.

Further, another critical parameter of a mobile part relates to the mass thereof. In fact, the lighter a mobile part is, the more it can be moved at a high frequency with a satisfactory amplitude at a constant activation energy level. In other words, the lighter a mobile part is, the more it allows a significant acceleration, allowing it to faithfully reproduce high frequencies and without generating a phenomenon of lag.

Finally, a third critical parameter of a broadband electrodynamic transducer is the resonant frequency thereof, which must be the lowest possible in order to reproduce low frequencies without attenuation. In fact, an electrodynamic transducer has a resonant frequency corresponding to a local maximum of impedance as a function of frequency. When the electrodynamic transducer operates at a frequency located below this resonant frequency, the movements of the transducer become limited and can be saturated whatever the frequency used. In contrast, when the electrodynamic transducer around operates at a frequency located above this resonant frequency, the displacements of the transducer decrease when the frequency increases. It is therefore necessary to look for an electrodynamic transducer whose resonant frequency is the lowest possible in order to avoid saturation of the movement of the electrodynamic transducer.

Obviously, the ideal mobile part is one which simultaneously has a very high stiffness, is extremely light as well and has a low resonant frequency.

In the domain of headphones, other critical parameters need to be considered, such as emitting surface, decompression volumes and the volume of perforations. In fact, an audio headset is subject to severe size constraints and the largest possible membrane is sought for use in order to improve the volume of air moved by the membrane. Further, air movement near the membrane leads to a reduced pressure or compression of air under the membrane. The decompression volumes of air for the membrane must therefore be sufficient to not slow the movement of the membrane.

A conventional solution consists of making the membrane and suspension from a single layer of polyester, for example Mylar® type. By implementing the suspension and membrane as a single part, the emitting surface can be increased by using a portion of the suspension to generate acoustic waves. The membrane is moved by a coil mounted self-supporting or on a support fixed on the lower surface of the membrane.

Although the material constituting the membrane is light, the weight of the mobile part is negatively impacted by the weight of the coil and the coil support, thus limiting the dynamics of the electrodynamic transducer.

To finish, a polyester membrane also has the disadvantage of deforming at high frequencies, specifically over 4 kHz. The result is that unwanted harmonics appear in the acoustic wave because of uncontrolled deformations of the membrane or the suspension. A polyester membrane acting as suspension also creates amplitude modulation during large excursions, thus generating distortion.

To remedy these problems, another solution proposes to use an aluminum or cellulose membrane in order to improve the stiffness of the membrane. With this solution, high frequency acoustic waves can effectively be generated while limiting distortions. However, the weight of the membrane negatively impacts the weight of the mobile part and limits the dynamics of the electrodynamic transducer.

Further, an electrodynamic transducer for audio headphones generally has a first resonance of the impedance thereof located between 2 and 4.5 kHz. This first resonance is defined by the characteristics of the mobile part and the collection of decompression volumes. Without action on the headphone architecture, the frequencies generated by the electrodynamic transducer below this first resonance are attenuated.

To remedy this problem and generate a clear signal over the audio frequency range, between 20 Hz and 20 kHz, the usual practice is to lay out perforations in the transducer and the headphone structure. These perforations form a resonance for frequencies below that of the first resonance so as to compensate for the attenuation of the frequencies below the frequency of the first resonance.

These perforations are provided with acoustically resistive paper or tissue so as to tune the resonance phenomena of the perforations. The result is that headphones conventionally have a second resonance in the impedance thereof located between 50 Hz and 150 Hz and defined by the features of the mobile part and that of the most massive and least damped perforation.

However, the use of perforations for generating low frequencies by resonance leads to a latency in the generation of low frequencies. Further, the presence of tissues or paper sheets limits the air decompression volume of the membrane.

The technical problem of the invention is to propose an electrodynamic transducer having an intrinsic low frequency resonance so as to limit or eliminate the use of perforations to form low frequencies, while guaranteeing a good compromise between the other parameters of the electrodynamic transducer.

BRIEF DESCRIPTION OF THE INVENTION

The invention proposes to resolve this technical problem by coupling a stiff membrane, preferably of aluminum or beryllium, with a self-supported coil on the membrane so as to eliminate the coil support and limit the weight of the mobile part.

According to a first aspect, the invention relates to a broadband electrodynamic transducer for headphones, where said transducer comprises:

- a magnetic motor configured for generating a magnetic field;
- a coil arranged in an air gap of said magnetic motor and mobile in translation under the effect of said magnetic field; and
- a membrane connected to said coil so as to convert the translational movement of said coil into an acoustic wave.

The invention is characterized in that said transducer comprises a self-supporting coil attached to said membrane by adhering, where said membrane has a Young's modulus over 40 GPa and in that said suspension has a thickness included between 50 and 100 μm.

The membrane composed of material whose Young's modulus is over 40 GPa corresponds to a stiff membrane made for example of aluminum or beryllium. The invention proposes to couple the advantages of this stiff membrane with a coil self-supported by the membrane, meaning without using a coil support.

The mechanical strength of the coil is provided solely by adhering the coils to each other. It results that the weight of the mobile part is greatly reduced by eliminating the coil support. Further, a low weight and high flexibility of the suspension can be achieved with the invention.

Contrary to any expectation, the inventors found that with the combination of a stiff membrane with a self-supported coil, a mobile part could be obtained that was light and able to reproduce high frequencies without distortion. Further, with the combination of this light mobile part and a very flexible suspension, an electrodynamic transducer having a single very low resonant frequency, around 40 Hz, could be obtained.

With the invention, the use of perforations can be eliminated or reduced and still reproduce low frequencies. For example, a beryllium membrane operates as a piston over the full audio frequency range, between 20 Hz and 20 kHz.

The dynamics of the electrodynamic transducer can be improved by eliminating all or part of the perforations, tissues or paper sheets, which increases the air decompression volume.

According to an embodiment, said membrane is implemented of a material chosen from the group comprising beryllium, magnesium and aluminum. Unlike other metallic materials whose Young's modulus is over 40 GPa, these materials provide a good compromise between stiffness and lightweight so as to not degrade the acceleration factor of the electrodynamic transducer.

According to an embodiment, said coil comprises a single conducting wire wound on itself along the height of said electrodynamic transducer. The weight of the coil and therefore the mobile mass can be limited with this embodiment.

According to an embodiment, said coil has a diameter included between 20 and 30 mm.

Unlike conventional coils, where the diameter is about 10 mm, by using a single winding self-supported coil, which is therefore very light, the diameter of the coil can be increased and the placement thereof on the membrane can be optimized.

Guiding of the membrane is thus improved and the forces are applied to an optimal region of the membrane for offsetting the nodal modes towards the highest frequency. Further with this embodiment a very large air decompression volume inside the coil can be released.

According to an embodiment, said coil has a height included between 4 and 5 mm. Unlike conventional coils, where the height is less than 3 mm, by using a single winding self-supported coil, which is therefore very light, the height thereof can be increased. For low frequencies, in which the displacements of the coil are larger, conventionally in devices from the state of the art, the coil leaves the air gap of the motor. This embodiment proposes to use a particularly high coil so as to enter more widely into the air gap and limit the excursion of the coil from the air gap. It follows from this that the guiding of the membrane is improved and distortions are reduced.

According to an embodiment, said electrodynamic transducer has an opening surface of over 35%. This opening surface corresponds to the ratio between the emitting surface of the membrane and the rear surface of the openings.

Unlike the transducers from the state of the art which require positioning of perforations and paper or tissue to create resonance modes in order to generate low frequencies, the dynamics of the electrodynamic transducer can be improved with this embodiment because the air volume variations generated by the movement of the membrane are evacuated without constraint through the central recess and the peripheral recess.

According to an embodiment, said electrodynamic transducer also comprises a suspension connecting an outer edge of said membrane to a fixed support, where said suspension is made of rubber.

Unlike transducers from the prior art which use the same material to form the suspension and the membrane, these two elements can be disassociated with this embodiment. A more effective suspension and membrane compared to those in the prior art can therefore be used, thereby allowing the electrodynamic transducer to reach low and high frequencies with very little distortion.

According to an embodiment, said electrodynamic transducer has a compliance over 40 mm/N.

According to a second aspect, the invention relates to an open or semi-open headset comprising an electrodynamic transducer according to the first aspect of the invention.

BRIEF DESCRIPTION OF THE FIGURES

The way to implement the invention as well as the advantages deriving therefrom will be clearly seen from the description of the following embodiment, supported by the appended figures in which.

WAYS TO IMPLEMENT THE INVENTION

Figure 1:
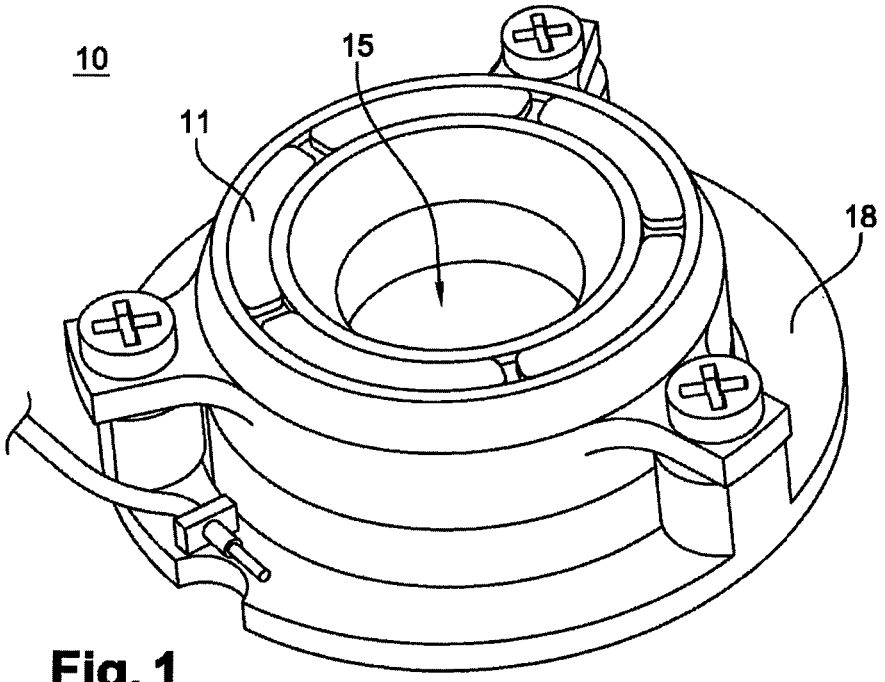
FIG. 1 is a rear perspective view of an electrodynamic transducer according to an embodiment of the invention.
Figure 2:
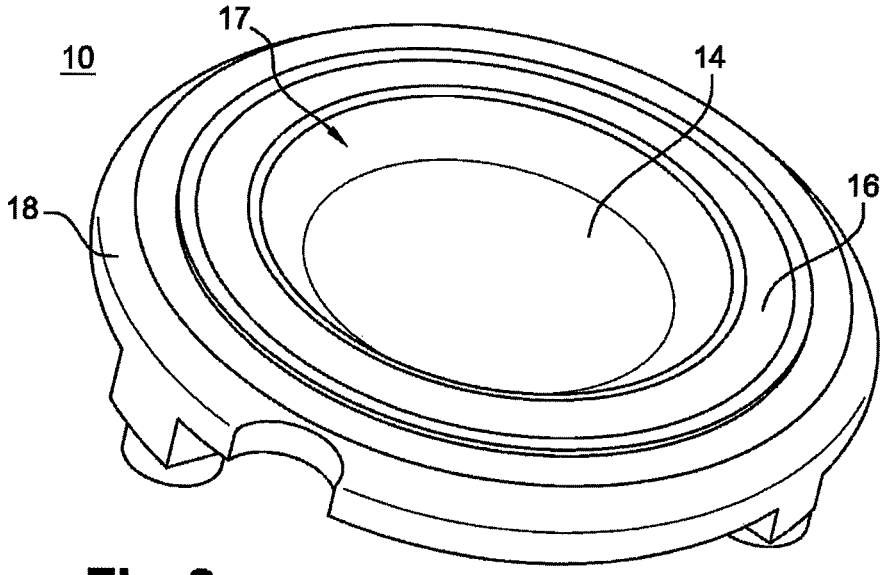
FIG. 2 is a front perspective view of the transducer from FIG. 1.
Figure 3:
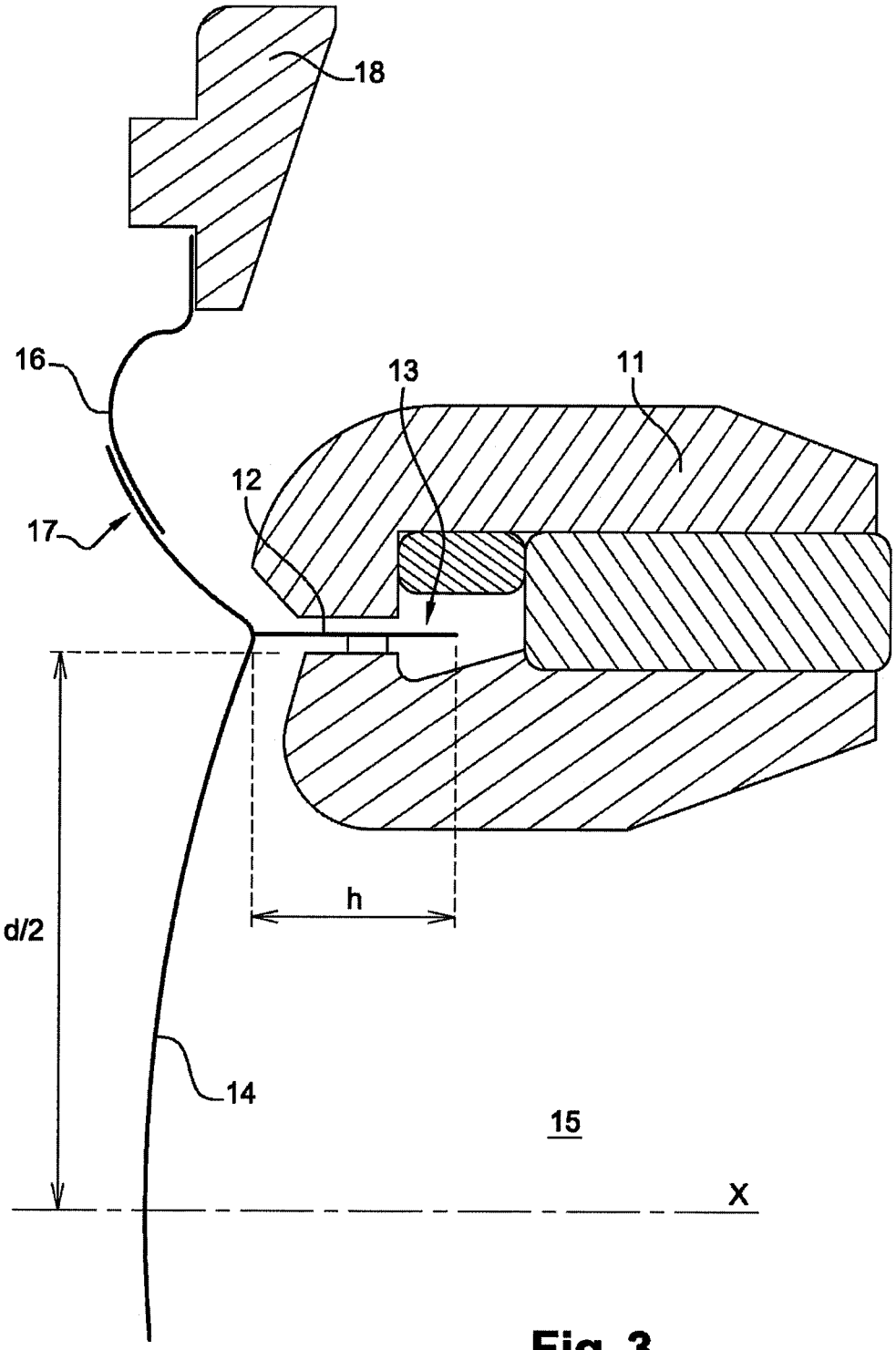
FIG. 3 is a partial section view of the transducer from FIG. 1.

FIGS. 1 to 3 are described with reference to an electrodynamic transducer 10 whose front surface has a membrane 14 and whose rear surface has a motor 11. Of course, the orientation of the front and rear surfaces can vary without changing the invention.

The motor 11 is a conventional motor and can take any of the known forms. Preferably, the motor 11 has a shape of revolution extending around a central axis x of the electrodynamic transducer 10. As shown in FIG. 1, the motor 11 can be attached on a fixed support 18 by means of three screws.

Preferably, the motor 11 comprises a central recess 15 so as to create a column for air expansion extending from the membrane 14 to the rear of the electrodynamic transducer 10. Preferably, this column for air expansion has a zero or nearly-zero acoustic impedance so as to limit the slowing of the membrane 14 as much as possible. Thus unlike the devices from the state of the art which require the use of perforations and paper to form low frequencies, a zero or nearly-zero acoustic impedance indicates that the acoustic transducer 10 does not comprise papers arranged behind the membrane 14, in the axis of the motor 11.

Further, the motor 11 has an air gap 13 intended to receive a coil 12. The coil 12 is fixed directly below the membrane 14 by adhering without using a support for coil 12 so as to limit the weight of the mobile part of the electrodynamic transducer 10. To do this, the coil 12 is preferably made with a single conducting wire wound on itself along the height of the electrodynamic transducer 10. The conducting wire can have a circular or square section. The conducting wire can be made of copper or of the "CAW" type, meaning it is composed of an aluminum core, copper cladding and a protective layer.

By heating the conducting wire, the windings of wire can be securely joined to each other by adhesion of the protective layers with each other, thereby providing the structure of the coil 12. The coil 12 is therefore particularly light.

Further a coil with a very large diameter and height (in the domain of headphones) can be obtained with this embodiment.

For example, a coil 12 with a diameter d included between 20 and 30 mm and a height h included between 4 and 5 mm can be obtained with this embodiment.

The inductance of the coil 12 is included between 150 and 250 μH contrary to the state of the art in which the inductance of the coil is generally included between 400 and 500 μH. As a variant, the coil 12 can have several series of windings without changing the invention.

The performance of the electrodynamic transducer 10 is also improved by the use of a membrane 14 having a Young's modulus over 40 GPa. Preferably, the membrane 14 is made of aluminum with a Young's modulus substantially equal to 69 GPa, or of beryllium with a Young's modulus substantially equal to 240 GPa. The thickness of the membrane 14 is preferably included between 20 and 30 μm for a diameter included between 30 and 32 mm. Thus, the membrane 14 is particularly stiff while also having some lightness compared to titanium or steel. The membrane 14 has a slightly protruding front surface forming a dome at the edges of which the coil 12 is attached. The membrane 14 also extends radially, after the dome, in a substantially straight terminal part 17 extending towards the fixed support 18.

The mobile part of the electrodynamic transducer 10 is completed by a dedicated suspension 16, preferably made of rubber. The suspension 16 extends in the form of a simple arc between the end part 17 of the membrane 14 and a radial edge of the fixed support 18.

Preferably, the suspension 16 has a thickness included between 50 and 100 μm. Preferably, the suspension 16 is fixed by adhering on the end part 17 of the membrane 14 and on the radial edge of the fixed support 18. By means of this suspension 16, the compliance of the electrodynamic transducer 10 is particularly improved. In fact, the compliance of the electrodynamic transducer 10 was measured at over 40 mm/N.

A conventional method for measuring the compliance is described in the measurement reference from Klippel GmbH dated Aug. 13, 2012: "Linear Parameter Measurement (LPM) S2."

A rear part of the electrodynamic transducer 10 is also open onto a part of the suspension 16 so as to limit slowing of the membrane 14. It follows that the electrodynamic transducer 10 has an opening surface area over 35%. This opening surface corresponds to the ratio between the emitting surface of the membrane 14 and the rear surface of the openings.

The resulting electrodynamic transducer 10 has spectacular performance. For example, for a membrane 14 made of aluminum, the total weight of the mobile part (including the membrane, suspension, coil and adhesive) does not exceed 160 mg. Similarly, for a membrane 14 made of beryllium, the total weight of the mobile part (including the membrane, suspension, coil and adhesive) does not exceed 125 mg. The mass measurements are done with a balance accurate to 0.1 mg.

To finish, two electrodynamic transducers 10 can be used to form a headset, for example an open or semi-open headset.

The invention claimed is:

1. A broadband electrodynamic transducer for headphones, where said transducer comprises:

a magnetic motor configured for generating a magnetic field;

a coil arranged in an air gap of said magnetic motor and mobile in translation under the effect of said magnetic field; and a membrane connected to said coil so as to convert the translational movement of said coil into an acoustic wave;

characterized in that said transducer comprises a self-supporting coil attached to said membrane by adhering, where said membrane has a Young's modulus over 40 GPa and in that said suspension has a thickness included between 50 and 100 μm; and wherein said magnetic motor comprises at least a central recess so as to create a column for air expansion extending from the membrane to a rear of said transducer so that the electrodynamic transducer presents an opening surface of over 35%, said opening surface corresponding to a ratio between an emitting surface of the membrane and a surface of the recess at the rear of said transducer.

2. The electrodynamic transducer according to claim 1, wherein said membrane is implemented of a material chosen from the group comprising beryllium, magnesium and aluminum.

3. The electrodynamic transducer according to claim 1, wherein said coil comprises a single conducting wire wound on itself along the height of said electrodynamic transducer.

4. The electrodynamic transducer according to claim 1, wherein said coil has a diameter (d) included between 20 and 30 mm.

5. The electrodynamic transducer according to claim 1, wherein said coil has a height (h) included between 4 and 5 mm.

6. The electrodynamic transducer according to claim 1, wherein said electrodynamic transducer also comprises a suspension connecting an outer edge of said membrane to a fixed support, where said suspension is made of rubber.

7. The electrodynamic transducer according to claim 1, wherein said electrodynamic transducer has a compliance over 40 mm/N.

8. A headset comprising an electrodynamic transducer according to claim 1.

* * * * *